US006289619B1

(12) United States Patent
Fuchs et al.

(10) Patent No.: US 6,289,619 B1
(45) Date of Patent: Sep. 18, 2001

(54) BREECH LOCK MECHANISM FOR A PISTOL

(75) Inventors: Rudolf Fuchs, Thayngen (CH); Theobald Förster, Jestetten (DE)

(73) Assignee: SIG Arms International AG (CH)

( * ) Notice: Subject to any disclaimer, the term of this patent is extended or adjusted under 35 U.S.C. 154(b) by 0 days.

(21) Appl. No.: 09/211,572

(22) Filed: Dec. 15, 1998

(30) Foreign Application Priority Data

Dec. 15, 1997 (DE) ..... 197 55 679

(51) Int. Cl.[7] ..... F41A 17/26
(52) U.S. Cl. ..... 42/69.03; 42/70.08
(58) Field of Search ..... 42/69.03, 70.08; 89/147

(56) References Cited

U.S. PATENT DOCUMENTS 3,724,113 * 4/1973 Lugwig ..... 42/70.08
4,208,947 * 6/1980 Hillberg ..... 89/148
4,312,263 * 1/1982 Bourlet ..... 89/154
5,400,537 3/1995 Meller et al. ..... 42/69.03

FOREIGN PATENT DOCUMENTS

198439 * 9/1938 (CH) ..... 42/70.08
3702228 1/1987 (DE) .
0013583 1/1980 (EP) .
0801285 10/1997 (EP) .

* cited by examiner

*Primary Examiner*—Stephen M. Johnson
(74) *Attorney, Agent, or Firm*—Webb Ziesenheim Logsdon Orkin Hanson, P.C.

(57) ABSTRACT

The breech lock unit has a housing in which a strike hammer is mounted so that it can be pivoted around a shaft. A drive lever can be pivoted on the same shaft to a limited extent in both directions with respect to the hammer. The hammer is biased by a spring against the one stop with the lever. Connected to the lever is a connecting rod which is biased by a striker spring and in the base position is in contact with a stop surface on the housing. The configuration described above makes possible a slim construction and optimum drive conditions. A plurality of functions that conventionally require separately installed components can be realized in the one breech lock unit.

12 Claims, 4 Drawing Sheets

BREECH LOCK MECHANISM FOR A PISTOL

BACKGROUND OF THE INVENTION

1. Field of the Invention

This invention relates to a breech lock mechanism for a pistol with a breech mechanism that can be moved on a grip piece, in which breech mechanism a firing pin is movably mounted and which, in its base position, projects beyond a rear end surface of the breech mechanism.

2. Description of the Currently Available Technology

EP-A-0 013 583 describes a trigger mechanism that is integrated into the grip of the pistol. A strike hammer can pivot around a shaft. A drive ring that can pivot to a restricted extent with respect to the hammer is pivotably mounted on the same shaft. An additional spring is inserted between the ring and the strike hammer. The trigger interacts with a ratchet lever that is engaged in a notch of the ring. When the hammer is cocked, it can be pivoted forward against the force of the second spring, where it engages with a pin on a hook of the trigger mechanism. When the trigger is pulled, first the pin is released, so that the hammer accelerates back into its cocked position, before the ring is released if the trigger is actuated further. It thereby becomes possible to do without a double-action trigger. In the base position of the hammer, in which it is pivoted forward, however, both springs are fully cocked. In the event of a sharp impact on the pistol, e.g. if it is dropped or falls on a hard surface, the vibration can cause the pistol to fire, which is dangerous. The vibration caused by the impact of the ring against the hammer immediately before the shot is fired also has a disadvantageous effect on the aiming accuracy and security of firing.

An object of the invention is to create a breech lock mechanism that provides increased safety. This object is accomplished by the combination of features disclosed in the claims.

SUMMARY OF THE INVENTION

A breech lock unit is provided for a pistol with a breech mechanism guided movably on a grip piece, in which breech mechanism there is a firing pin that is movably mounted and in a base position projects beyond a rear end surface of the breech mechanism. The breech lock unit includes a housing and a strike hammer mounted in the housing and pivotable around a first shaft. A drive lever is mounted such that the drive lever is pivotable around the first shaft and is pivotable with respect to the strike hammer such that when a shot is discharged, the drive lever drives the strike hammer by a first stop. A return spring is positioned between the drive lever and the strike hammer and is configured to apply a load to the hammer in a direction of the first stop. A striker rod is connected to the drive lever at a distance from the first shaft. A biased striker spring is configured to apply a load to the striker rod in a direction of a firing position of the strike hammer and is supported on the housing. A second stop is configured to stop the movement of the drive lever before the strike hammer strikes the firing pin.

BRIEF DESCRIPTION OF THE DRAWINGS

The invention is explained in greater detail below, with reference to the exemplary embodiment illustrated in the accompanying drawings, in which.

DESCRIPTION OF THE PREFERRED EMBODIMENT

Figure 5:
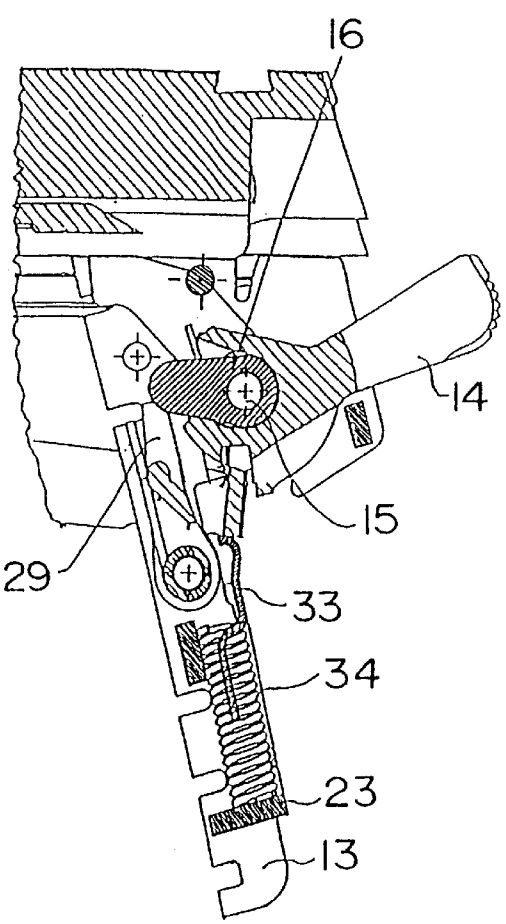
Figure 4:
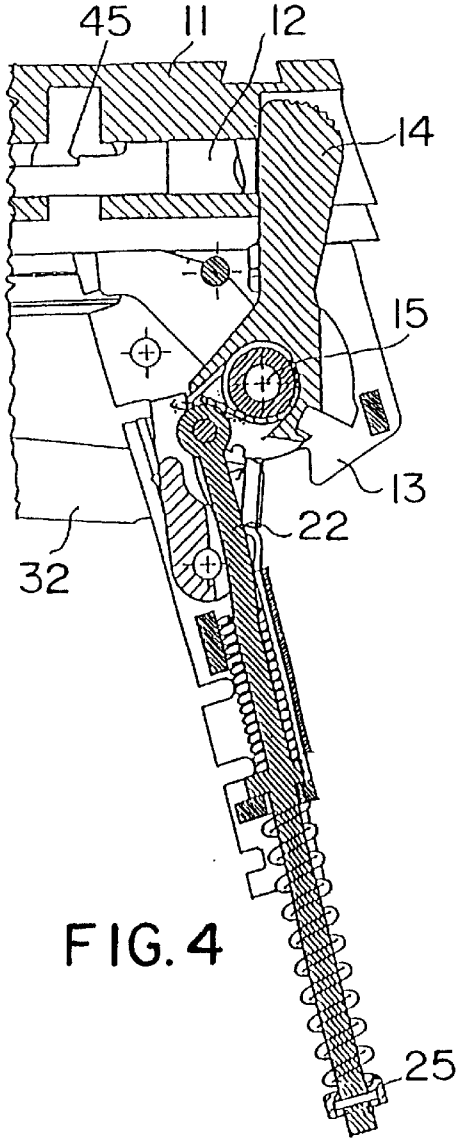

The breech lock mechanism 10 illustrated in the accompanying figures is inserted as a self-contained unit into the pistol grip 61 of a grip 60 of the pistol. Movably mounted on the grip 60 is a breech mechanism 11 in which the barrel is mounted. A firing pin 12 is capable of moving inside the breech mechanism 11, and is biased by a force applied by a spring in its rear base position illustrated in FIGS. 1, 2 and 5, in which it projects beyond a rear end surface 9 of the breech mechanism 11. The breech lock unit 10 has a housing 13. In the housing 13, a stroke hammer 14 is mounted so that it can pivot around a first shaft 15. A drive lever 16 can pivot on the same shaft 15. The pivoting motion of the lever 16 with respect to the hammer 14 is restricted by two stop surfaces 17, 18 of the hammer 14 in the two directions of rotation. The strike hammer 14 is biased by a spring 19 with respect to the lever 16 toward the rear against the first stop or stop surface 17. A percussion rod 22 is connected to the lever 16, at some distance from the shaft 15. The rod 22 is guided in a boring 23 of a transverse web 24 of the housing 13.

Between a disc 25 secured on the end of the rod by a transverse pin and the web 24, the prestressed striker spring 26 is inserted, which applies tension to the rod 22. In the base position illustrated in FIGS. 1 to 3, a second stop or stop surface 27 of the rod 22 is in contact against the web 24. The strike surface 28 of the hammer 14 in this base position is at an angle of approximately 150 with respect to the rear end surface 9 of the breech mechanism 11 so that, if the breech mechanism 11 is pushed backward by an impact, the hammer 14 cannot strike the firing pin 12. The hammer 14 is engaged with a first catch 31 in a spring-loaded pawl 29. The lever 16 has some play with respect to the contact surface 17.

The hammer 14 interacts in a known manner with a trigger rail 32. In the housing 13, a slide 33 is mounted so that it can be displaced, and presses the rail 32 by means of a spring 34 in engagement into a catch 35 of the hammer 14. An uncocking lever 36 is also rotationally mounted on a second shaft 44. By means of the uncocking lever 36, the hammer 14 can be pivoted back out of the cocked position illustrated in FIG. 5 into the base position illustrated in FIGS. 1 to 3. Also fastened to the housing 13 is an ejector mechanism 37 which, after the shot has been fired, ejects the empty cartridge through an opening in the breech mechanism 11.

Figure 6:
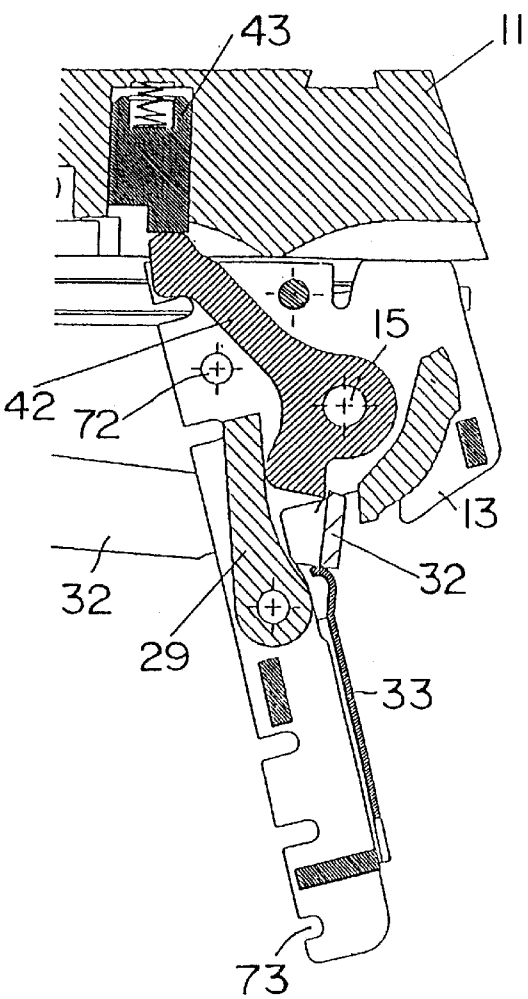
FIGS. 4 to 6 are illustrations of the breech lock mechanism illustrated in FIGS. 1 and 2 in the firing position and in the cocked position.

The breech lock unit 10 functions as follows: When the trigger is pulled, the rail 32 is pulled forward. It pivots a safety lever 42 (FIG. 6), which can also pivot around the shaft 15 and presses a safety slide 43 out of a locking catch 45 of the firing pin 12, on which a downward load is exerted by a spring 46. The lever 42 presses the pawl 29 forward out of its engagement with the catches 31, 38. The rail 32, by means of its engagement in the recess or catch 35, drives the hammer 14 against the force of the spring 26 into the cocked position illustrated in FIG. 5. The rail 32 runs along a control cam 47 (FIG. 6), which displaces it against the force of the spring 34 downward and out of engagement with the catch 35. The hammer 14 is released, so that the spring 26, by means of the impact rod 22 acting as a connecting rod, the lever 26 and the stop surface 17, accelerates the hammer 14 against the breech mechanism 11, until the surface 27 comes into contact against the web 24. As a result of the mass inertia of the hammer 14, said hammer 14 continues to rotate, strikes the firing pin 12 and initiates the firing process. After the shot has been fired, the breech mechanism 11 slides back and the empty cartridge shell is ejected. The process described above is conventionally called "double action" (DA). When, after the shot has been fired or as a result of manual action, the breech mechanism slides backward, a control cam of the breech mechanism pivots the trigger rail 32 downward and the hammer 14 backward, so that the hammer is engaged with the second catch 38 on the pawl 29. When the trigger is released, the rail 32 slides backward into engagement with the lever 42 which, the next time the trigger is actuated, pushes the pawl 29 out of the catch 38 after it moves past the DA firing position (single action).

Figure 3:
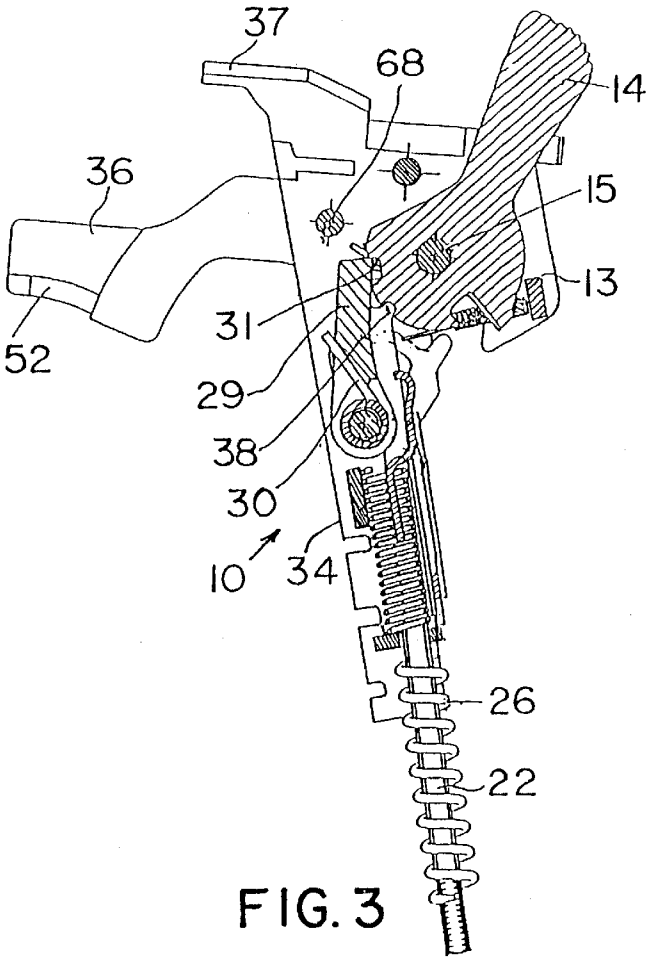
FIGS. 1 to 3 show a breech lock mechanism in cross sections through various planes in the base position.
Figure 2:
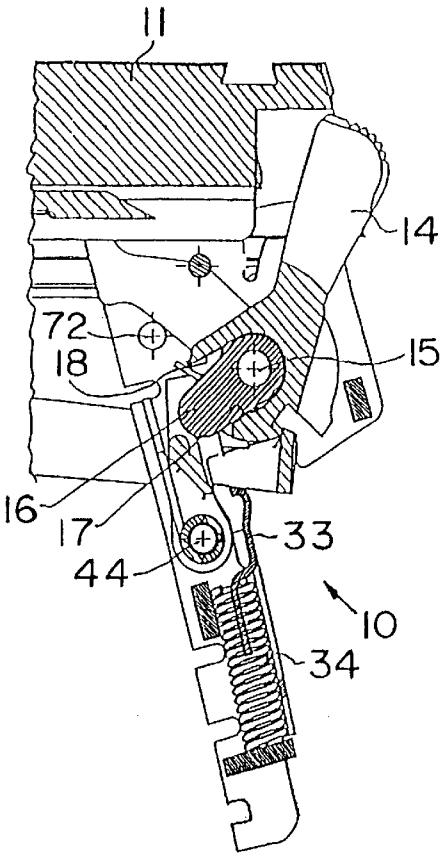
Figure 1:
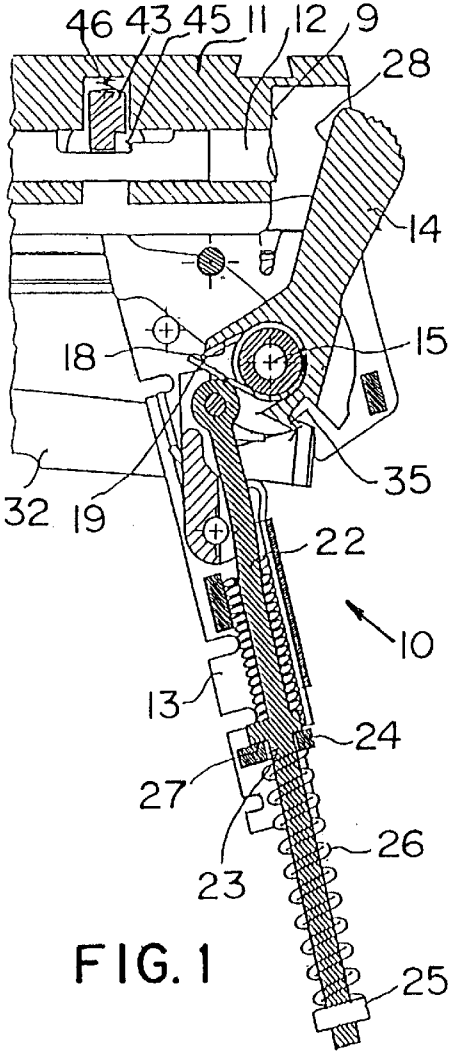
Figure 8:
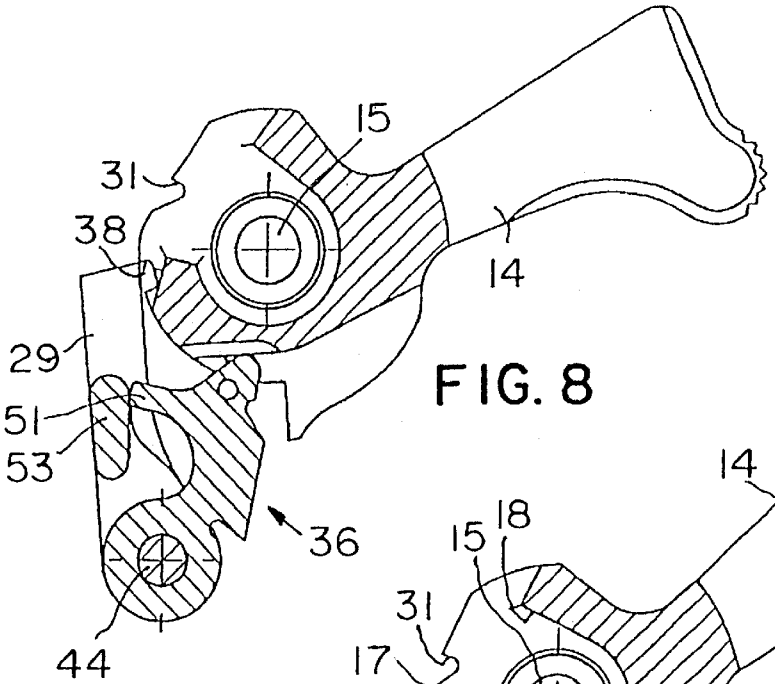
FIGS. 7 to 9 illustrate the function of the uncocking lever.
Figure 9:
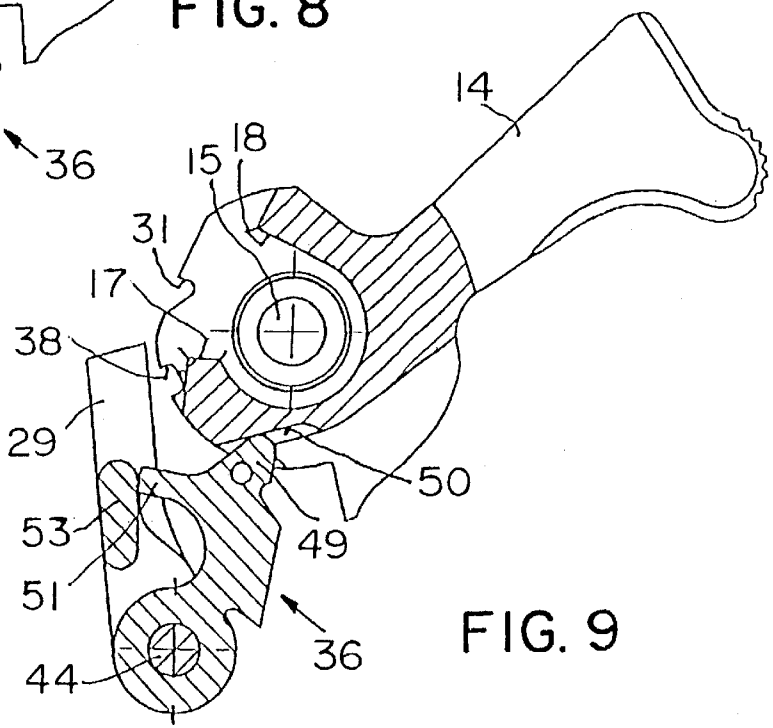
Figure 7:
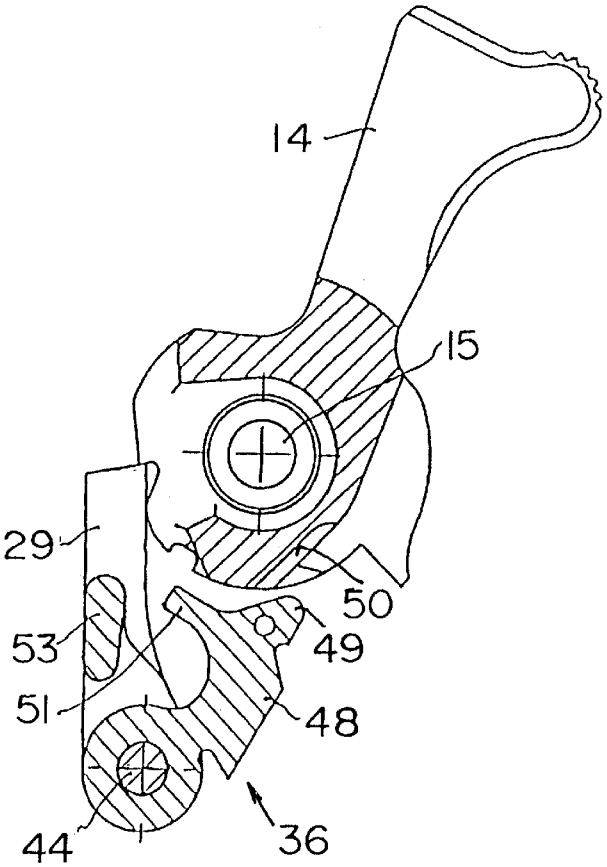

FIGS. 7 to 9 illustrate the function of the uncocking lever 36. FIG. 7 shows the uncocking lever 36 in the base position and the strike hammer 14 in its safety position as illustrated in FIGS. 1 to 3, in which the pawl 29 is engaged in the safety catch 31. The uncocking lever 36 has an arm 48 with a second means, e.g. a projecting lug 49, which interacts with a slide surface of the strike hammer 14. A first means, e.g. a trigger tab 51, projects forward from the arm 48. When the grip 52 of the uncocking lever 36 is depressed, the trigger tab presses against a web 53 of the pawl 29. When the hammer 14 with its single-action catch 38 is engaged in the pawl 29, the pawl 29 is thereby pivoted out of engagement with this catch 38. FIG. 8 shows this process immediately before the release of the hammer 14. As the uncocking lever 36 pivots further, the hammer 14 is released, so that the slide surface 50 impacts the lug 49 (FIG. 9). As the uncocking lever 36 pivots back, the hammer 14 is gently returned by the sliding of the lug 49 on the surface 50 and simultaneously the pawl 29 is released once again, so that it engages in the catch 31 (FIG. 7).

Figure 10:
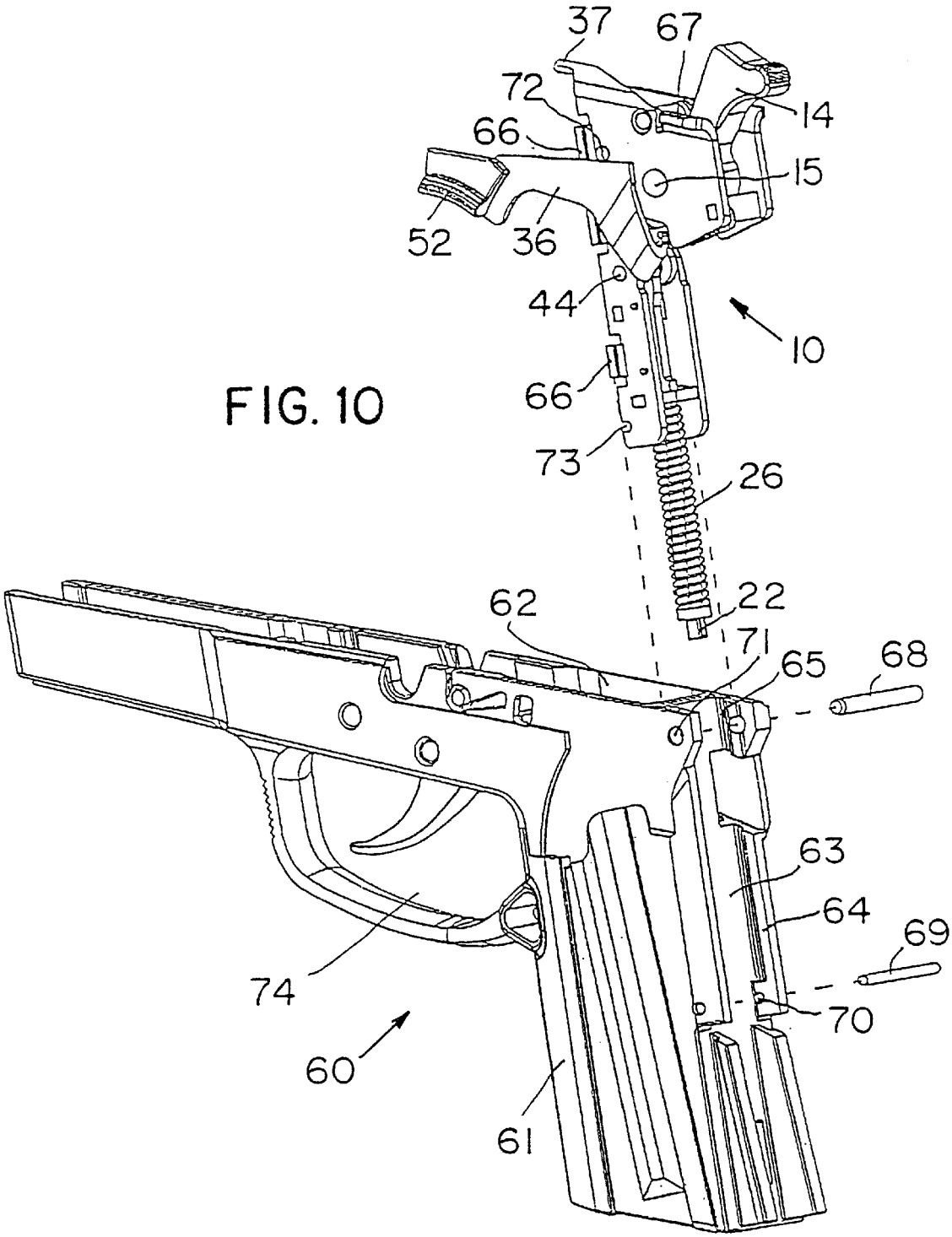
FIG. 10 is a view of the pistol in perspective.

FIG. 10 illustrates the installation of the breech lock unit 10 into the grip piece 60 of the pistol. The grip piece 60, in the pistol grip 61, has a magazine shaft 62 that runs at an angle to the axis for the insertion of a magazine, which is closed at the back by a rear wall 63. The two side walls 64 that continue beyond the wall 63 have grooves 65 with a rectangular cross section that run parallel to the wall 63. The breech lock unit 10, on the forward edge on both sides, has two molded rails 66 that project laterally and fit into the grooves 65. The breech mechanism 11 is guided in two additional rails 67 on the upper edge of the housing 13. The breech lock unit 10 is inserted from above into the grip piece 60 and is secured by two cross-bolts 68, 69 which are inserted through transverse borings 70 to 72 in the two side walls 64 and in the housing 13, or recesses 73 in the housing 13. FIG. 10 also shows the trigger tab 74, which is pivotably mounted in a front insert (not shown). The front insert also has lateral rails that correspond to the rails 67 to guide the breech mechanism 11. The trigger rail 32 is pivotably connected to the trigger tab 74.

Because the striker rod 22 transmits the spring force by tension, and the point of application of force of the striker rod 22 with respect to the hammer 14 is therefore in front of the shaft 15, the breech lock unit described above is slimmer than is possible with the pressure transmission mechanisms of the prior art, and optimal drive conditions are achieved, because the striker rod 22 in the pistol grip must be installed inclined downward and toward the rear. By integration of the slide 33 into the trigger rail 32 of the uncocking lever 36, of the safety lever 42 and of the ejector mechanism 37, a plurality of functions can be combined in one compact unit, which simplifies manufacture.

Because the hammer 14 in the base position is locked in the safety catch 31 and the striker rod 22 is stopped against the stop 24, there is multiple protection against an unintentional discharge. A first safety measure is the above referenced protection provided by the inclination of the striking surface 28. A second safety measure is the securing of the firing pin by the safety slide 43. A third safety measure is provided by the uncocking lever 36. If the person using the pistol uncocks the strike hammer by holding it back, actuating the trigger and then slowly returning the hammer 14, after the trigger has been released, the hammer 14 is automatically returned to the safety catch 31. Because the breech lock unit 10 is inserted into the grip piece 60 as a pre-assembled unit, it can easily be replaced by another breech lock unit 10, for example so that the original can be repaired. It is also possible to prepare a plurality of different breech lock units 10, e.g. in addition to the unit described above, a unit can be used that does not have the catch 38, so that the pistol is a double-action-only pistol. Breech lock units with different impact forces can also be made available for different types of ammunition. The breech lock unit described above therefore also makes it possible to adapt the pistol to meet different requirements.

What is claimed is:

1. A piston, comprising:

a breech mechanism guided movably on a grip piece, in which breech mechanism there is a firing pin that is movably mounted and in a base position projects beyond a rear end surface of the breech mechanism; and a breech lock unit, comprising:

a housing;

a strike hammer mounted in said housing and pivotable around a first shaft, said strike hammer having a first catch;

a drive lever mounted such that said drive lever is pivotable around said first shaft and which drive lever is pivotable with respect to said strike hammer such that when a shot is discharged, said drive lever drives said strike hammer by a first stop;

a return spring positioned between said drive lever and said strike hammer, which return spring is configured to apply a load to said strike hammer in a direction of said first stop;

a striker rod connected to said drive lever at a distance from said first shaft;

a biased striker spring which is configured to apply a load to said striker rod in a direction of a firing position of said strike hammer and which is supported on said housing;

a second stop configured to stop the movement of said drive lever before said strike hammer strikes the firing pin; and a spring-loaded pawl which engages in said first catch of said strike hammer in a base position when said striker spring is relaxed.

2. A pistol as claimed in claim 1, wherein said strike hammer includes a second catch in which said pawl engages when said strike hammer is cocked.

3. A pistol as claimed in claim 2, including an uncocking lever mounted in said housing and pivotable around a second shaft, wherein said uncocking lever has a first means to disengage said pawl from said second catch, as well as a second means to return said strike hammer into the base position to engage said pawl into said first catch.

4. A pistol as claimed in claim 3, wherein said first means includes a trigger tab and said second means includes a lug.

5. A pistol as claimed in claim 1, wherein said strike hammer is pivotable back into the base position with respect to a firing position such that when the breech mechanism is pushed rearwardly, only the breech mechanism, but not the firing pin, touches said strike hammer.

6. A pistol as claimed in claim 1, including means for moving a safety element in the breech mechanism out of a safety catch of the firing pin when a trigger is actuated.

7. A pistol as claimed in claim 6, wherein said moving means is a safety lever.

8. A pistol as claimed in claim 1, wherein integrated into said breech lock unit is a spring-loaded slide which, when said breech lock unit is inserted, applies a bias to a trigger rod upwardly to engage in a recess of said strike hammer.

9. A pistol as claimed in claim 1, including an ejector mechanism fastened to said housing.

10. A pistol as claimed in claim 1, wherein said housing includes rails that project laterally on both sides and configured to be inserted in grooves of side walls of the grip piece and wherein said housing is configured to be secured in the grip piece by at least one transverse pin.

11. A pistol, comprising:

a breech mechanism guided movably on a grip piece, in which breech mechanism there is a firing pin that is movably mounted and in a base position projects beyond a rear end surface of the breech mechanism; and a breech lock unit, comprising:

a housing;

a strike hammer mounted in said housing and pivotable around a first shaft;

a drive lever mounted such that said drive lever is pivotable around said first shaft and which drive lever is pivotable with respect to said strike hammer such that when a shot is discharged, said drive lever drives said strike hammer by a first stop;

a return spring positioned between said drive lever and said strike hammer, which return spring is configured to apply a load to said strike hammer in a direction of said first stop;

a striker rod connected to said drive lever at a distance from said first shaft;

a biased striker spring which is configured to apply a load to said striker rod in a direction of a firing position of said strike hammer and which is supported on said housing; and a second stop configured to stop the movement of said drive lever before said strike hammer strikes the firing pin, wherein integrated into said breech lock unit is a spring-loaded slide which, when said breech lock unit is inserted, applies a bias to a trigger rod upwardly to engage in a recess of said strike hammer.

12. A pistol, comprising:

a breech mechanism guided movably on a grip piece, in which breech mechanism there is a firing pin that is movably mounted and in a base position projects beyond a rear end surface of the breech mechanism; and a breech lock unit, comprising:

a housing;

a strike hammer mounted in said housing and pivotable around a first shaft;

a drive lever mounted such that said drive lever is pivotable around said first shaft and which drive lever is pivotable with respect to said strike hammer such that when a shot is discharged, said drive lever drives said strike hammer by a first stop;

a return spring positioned between said drive lever and said strike hammer, which return spring is configured to apply a load to said strike hammer in a direction of said first stop;

a striker rod connected to said drive lever at a distance from said first shaft;

a biased striker spring which is configured to apply a load to said striker rod in a direction of a firing position of said strike hammer and which is supported on said housing; and a second stop configured to stop the movement of said drive lever before said strike hammer strikes the firing pin, wherein said housing includes rails that project laterally on both sides and configured to be inserted in grooves of side walls of the grip piece and wherein said housing is configured to be secured in the grip piece by at least one transverse pin.

* * * * *

UNITED STATES PATENT AND TRADEMARK OFFICE

CERTIFICATE OF CORRECTION

PATENT NO. : 6,289,619 B1
DATED : September 18, 2001
INVENTOR(S) : Rudolf Fuchs et al.

It is certified that error appears in the above-identified patent and that said Letters Patent is hereby corrected as shown below:

Column 2,
Line 37, "150" should read -- 15° --.

Column 4, claim 1,
Line 29, "A piston" should read -- A pistol --.

Signed and Sealed this

Sixteenth Day of April, 2002

*Attest:*

*Attesting Officer*

JAMES E. ROGAN
*Director of the United States Patent and Trademark Office*